US006571478B1

(12) United States Patent
Romani et al.

(10) Patent No.: US 6,571,478 B1
(45) Date of Patent: Jun. 3, 2003

(54) VACUUM ATTACHMENT AND METHOD OF CONVERTING HAIR GROOMING CLIPPER TO MOUNT VACUUM ATTACHMENT

(75) Inventors: R. Marlene Romani, Indiana, PA (US); Domenick A. Romani, Indiana, PA (US)

(73) Assignee: M.D.C. Romani, Inc., Indiana, PA (US)

( * ) Notice: Subject to any disclaimer, the term of this patent is extended or adjusted under 35 U.S.C. 154(b) by 0 days.

(21) Appl. No.: 10/007,600

(22) Filed: Dec. 5, 2001

(51) Int. Cl.[7] ..... B25F 3/00
(52) U.S. Cl. ..... 30/133; 30/132
(58) Field of Search ..... 30/133, 216, 123, 30/124, 132, 41.5; 15/339

(56) References Cited

U.S. PATENT DOCUMENTS 2,748,472 A * 6/1956 Sheley et al. ..... 30/133
3,331,130 A * 7/1967 Ligon ..... 30/133
3,348,308 A * 10/1967 Andis ..... 30/133
3,384,919 A * 5/1968 Jording et al. ..... 15/339
3,440,681 A * 4/1969 Hixson et al. ..... 15/339
5,088,199 A * 2/1992 Romani ..... 30/133
5,881,462 A * 3/1999 Romani ..... 30/133
5,924,202 A * 7/1999 Romani ..... 30/133
6,076,263 A * 6/2000 Andis et al. ..... 30/216

* cited by examiner

*Primary Examiner*—Hwei-Siu Payer
(74) *Attorney, Agent, or Firm*—Michael R. Swartz; John R. Flanagan

(57) ABSTRACT

A vacuum attachment mountable on a forward end of a hair grooming clipper includes a conduit body enclosing an internal air flow passage between inlet and outlet ends thereof such that flow of hair cuttings entrained in air can be drawn from front cutting blades of a cutting head mechanism of the clipper via the inlet end through the passage to an external hose coupled to the outlet end, and mounting wings integrally and externally formed on the conduit body and extending from opposite sides thereof such that the conduit body and mounting wings define a replacement cover that can substitute for and replace the original equipment cover removed from the forward end of the casing of the clipper in order to enclose the opening in the forward end of the casing of the clipper.

20 Claims, 5 Drawing Sheets

VACUUM ATTACHMENT AND METHOD OF CONVERTING HAIR GROOMING CLIPPER TO MOUNT VACUUM ATTACHMENT

BACKGROUND OF THE INVENTION

1. Field of the Invention

The present invention generally relates to hair grooming clipper attachments and, more particularly, is concerned with a vacuum attachment for mounting to a hair grooming clipper and a method of converting a hair grooming clipper to mount a vacuum attachment.

2. Description of the Prior Art

To obviate concerns of professional dog groomers with breathing of fine dog hair and other foreign matter in the lungs, vacuum systems are often employed with hair grooming clippers. Typically, a vacuum system includes a suction head that is attached to a hand-held clipper adjacent to its cutting head mechanism and is connected to one end of a flexible hose. The other end of the hose is connected directly or via an intermediate conduit to a vacuum generating unit for creating a vacuum in the hose. The vacuum condition draws air into the hose through the suction head, entraining hair cuttings in the air flow through the hose to the vacuum generating unit where the hair cuttings are collected, typically, in a container.

Attachments have been developed over the years which provide a vacuum system for the disposal of hair cuttings from the clippers. Highly effective prior art vacuum attachments are disclosed in U.S. Pat. Nos. 5,088,199 and 5,881,462 to Romani. These prior art vacuum attachments introduced features which operate to remove hair clippings in a highly effective way. However, to employ these vacuum attachments on particular prior art clippers the design of these attachments followed one of two approaches.

Under the first approach followed in the design of the vacuum attachment of U.S. Pat. No. 5,088,199, externally-exposed fastening elements already provided on the particular prior art clipper for other purposes were used to mount the vacuum attachment. However, a disadvantage of this first approach is that it cannot be followed with respect to those prior art clippers with no externally-exposed fastening elements.

Under the second approach followed in the design of the vacuum attachment of U.S. Pat. No. 5,881,462, with respect to prior art clippers having no such eternally-exposed fastening elements the design of the vacuum attachment was conformed to the external configuration of the particular prior art clipper so as to allow it to be adhesively fastened thereto. However, a disadvantage of this second approach is that it effects a more or less permanent alteration of the prior art clipper which cannot easily be reversed should that become desirable to do so later on.

Consequently, there is a need for a third approach to the design of a vacuum attachment that will take advantage of both internal and external fastening features of a particular prior art clipper without effecting a permanent modification of the prior art clipper.

SUMMARY OF THE INVENTION

The present invention provides a vacuum attachment and a method of converting a hair grooming clipper to mount the vacuum attachment which are both designed to satisfy the aforementioned need. The vacuum attachment is adapted for mounting to the hair grooming clipper and a portion of the hair grooming clipper is adapted to be converted to a state of setup to accommodate mounting the vacuum attachment to it.

Accordingly, the present invention is directed to a vacuum attachment for use with a hair grooming clipper. The vacuum attachment comprises: (a) a conduit body for mounting on a forward end of a casing of a hair grooming clipper adjacent to front cutting blades of a cutting head mechanism of the clipper, the conduit body defining and enclosing an internal air flow passage extending between inlet and outlet ends of the conduit body such that when the conduit body is mounted on the forward end of the casing of the clipper a flow of hair cuttings entrained in air can be drawn from the front cutting blades of the cutting head mechanism of the clipper via the inlet end of the conduit body through the passage thereof to an external hose coupled to the outlet end of the conduit body; (b) a pair of mounting wings integrally and externally formed on the conduit body and extending from opposite sides of the conduit body such that the mounting wings and a portion of the conduit body extending between the mounting wings define a replacement cover that can substitute for and replace an original equipment cover removably provided on the forward end of the casing of the clipper in order to enclose an opening in the casing through which is exposed the cutting head mechanism of the clipper; and (c) means for detachably fastening the mounting wings to the forward end of the casing of the clipper.

The present invention also is directed to a method of converting a hair grooming clipper to mount a vacuum attachment. The converting method comprises the steps of: (a) providing a vacuum attachment including a conduit body and mounting wings integrally and externally formed thereon, the conduit body enclosing an internal air flow passage extending between inlet and outlet ends of the conduit body such that when the vacuum attachment is mounted on a forward end of a casing of a hair grooming clipper a flow of hair cuttings entrained in air can be drawn from front cutting blades of a cutting head mechanism of the clipper via the inlet end of the conduit body through the passage thereof to an external hose coupled to the outlet end of the conduit body; (b) removing from the forward end of the casing of the clipper an original equipment cover removably provided thereon adjacent to the cutting head mechanism to expose an opening in the forward end of the casing overlying the cutting head mechanism; (c) installing the conduit body on the forward end of the casing of the clipper so as to close the opening therein with a replacement cover, formed by the mounting wings and a portion of the conduit body extending between the mounting wings, that can substitute for and replace the original equipment cover removed from the forward end of the casing of the clipper in order to enclose the opening in the forward end of the casing of the clipper; and (d) detachably fastening the mounting wings to the forward end of the casing of the clipper.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
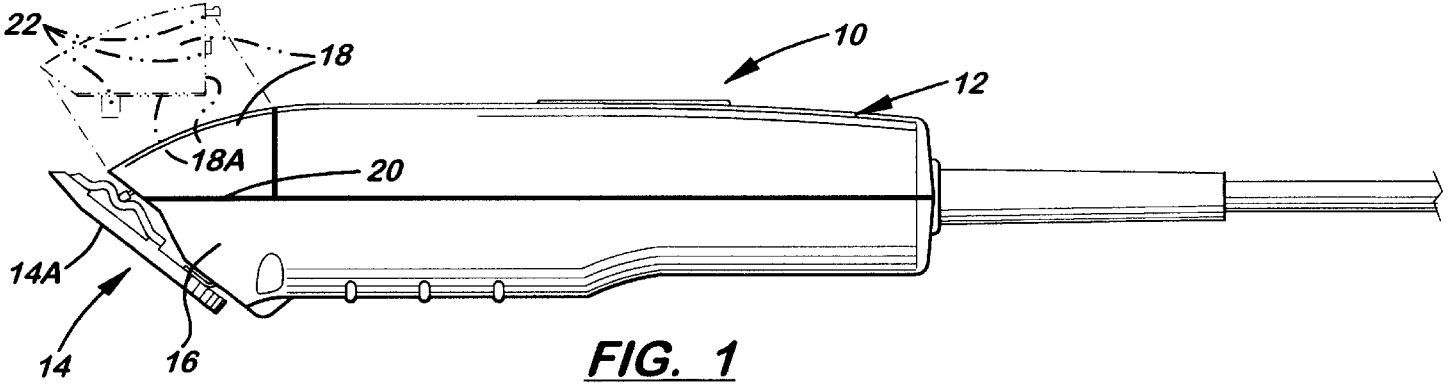
FIG. 1 (PRIOR ART)
FIG. 1 is a side elevational view of a prior art hair grooming clipper having a cover for a forward cutting head mechanism being shown in solid line form installed on the clipper and in dashed line form removed from the clipper.
Figure 3:
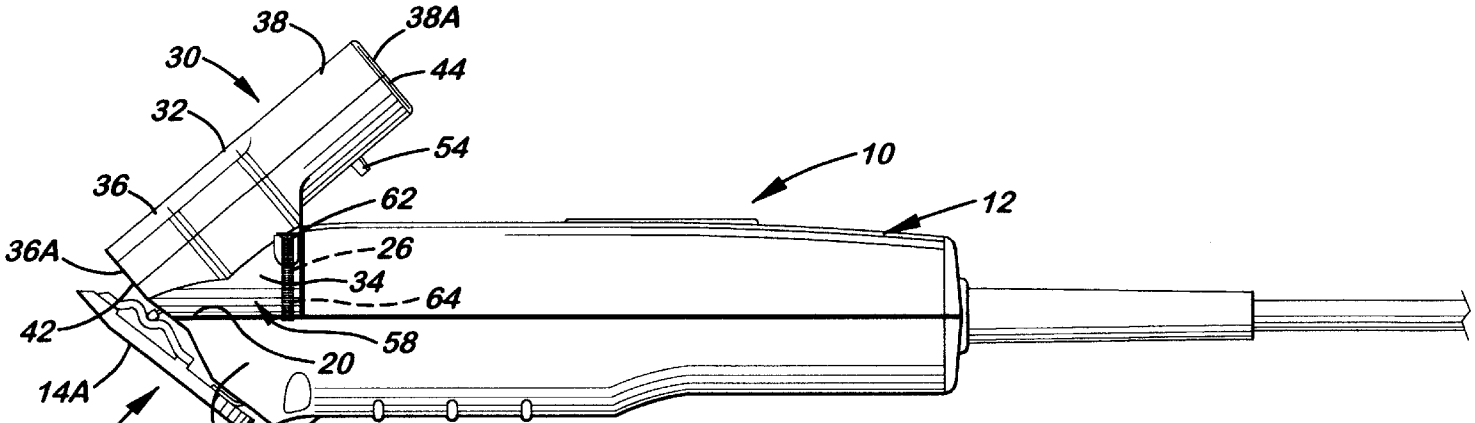
FIG. 3 is a side elevational view of the prior art clipper of FIG. 1 now showing a vacuum attachment of the present invention installed on the clipper in place of the cover of the clipper.

Referring to the drawings and particularly to FIG. 1, there is illustrated a prior art hair grooming clipper, generally designated 10, having an elongated casing 12, a hair cutting mechanism 14 with front cutting knives 14A supported at a forward end 16 of the casing 12, and a cover 18 removably installed on the forward end 16 of the casing 12. As seen in solid line form in FIG. 1, when the cover 18 is installed on the forward end 16 of the casing 12 of the clipper 10, the cover 18 overlies and closes an opening 20 defined in the forward end 16 of the casing 12. As seen in dashed line form in FIG. 1 and as also seen in FIG. 3, when the cover 18 is removed from the forward end 16 of the casing 12, the cover 18 allows access through the opening 20 of the casing 12 to an internal portion 14B of the cutting head mechanism 14 that is housed in the forward end 16 of the casing 12. The cover 18 has tabs 22 integrally formed on, spaced from one another along, and projecting outwardly from a peripheral edge 18A of the cover 18. The tabs 22 are shaped to frictionally and releasably engage and mate with complementarily shaped elements 24 on the forward end 16 of the casing 12 which are defined on the casing 12 and spaced from one another about the perimeter of the opening 20 of the casing 12. The internal portion 14B of the cutting head mechanism 14 that is exposed through the opening 20 of the casing 12 when the cover 18 is removed includes a pair of threaded female sockets 26 disposed in the casing 12 and a pair of threaded male fasteners 28, such as screws, which are threadably screwed therein.

Figure 2:
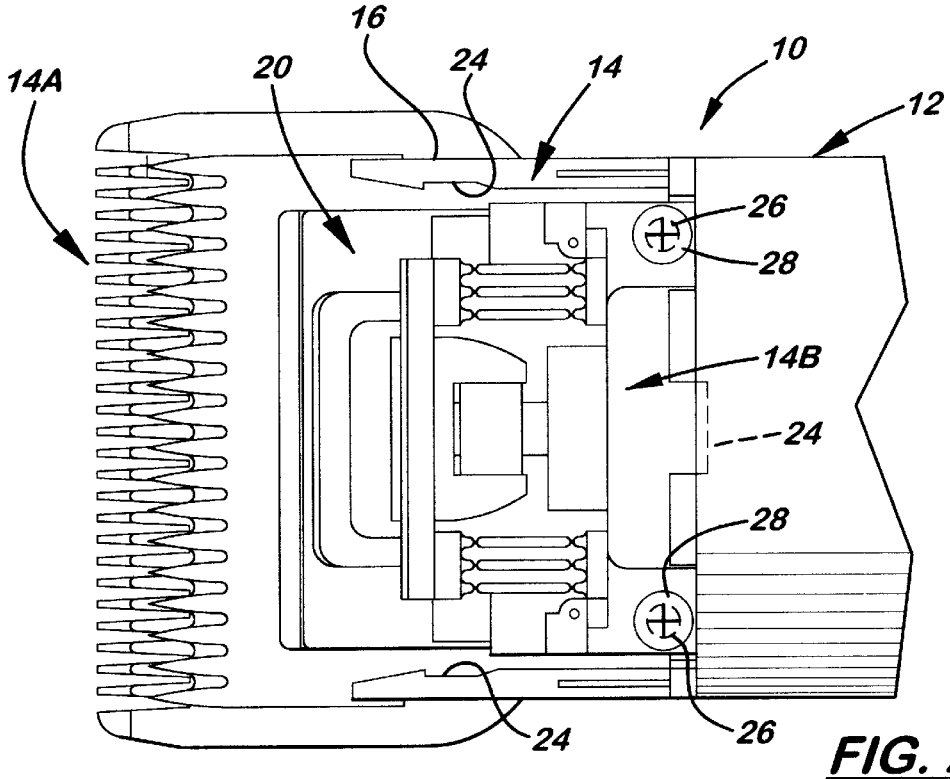
FIG. 2 (PRIOR ART)
FIG. 2 is an enlarged fragmentary top plan view of the clipper showing its forward cutting head mechanism with the cover removed.
Figure 4:
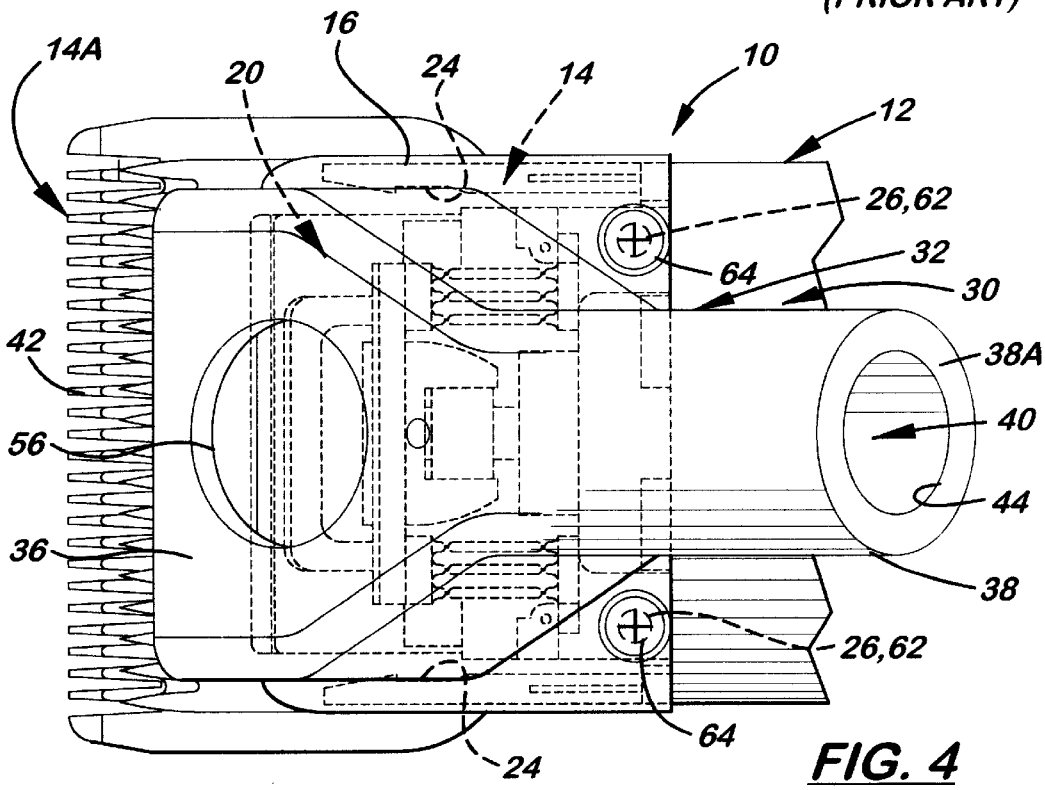
FIG. 4 is a view similar to that of FIG. 2 but now showing the vacuum attachment installed on the clipper.
Figure 5:
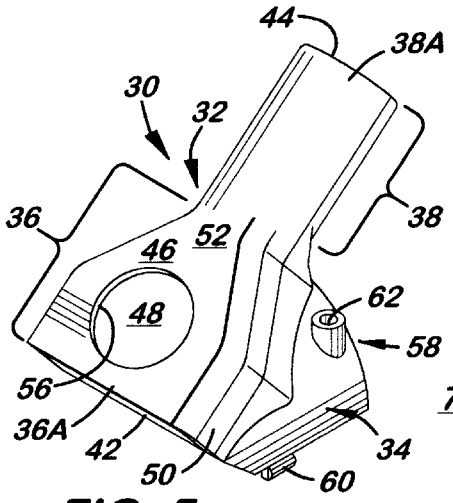
FIG. 5 is a perspective view of the vacuum attachment of the present invention by itself.
Figure 6:
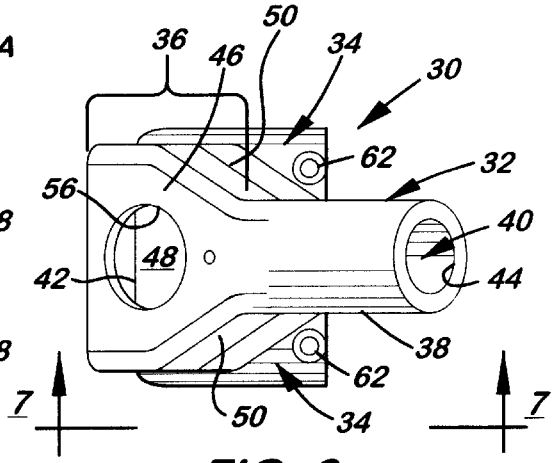
FIG. 6 is a top plan view of the vacuum attachment of FIG. 5.
Figure 8:
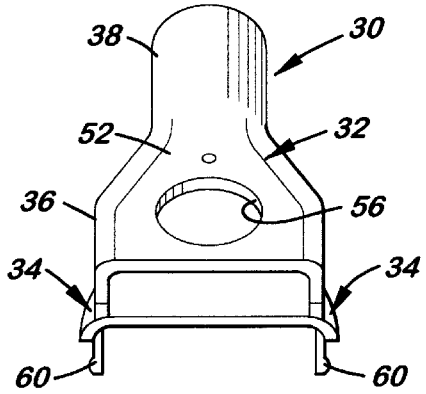
FIG. 8 is a front elevational view of the vacuum attachment as seen along line 8—8 of FIG. 7.
Figure 7:
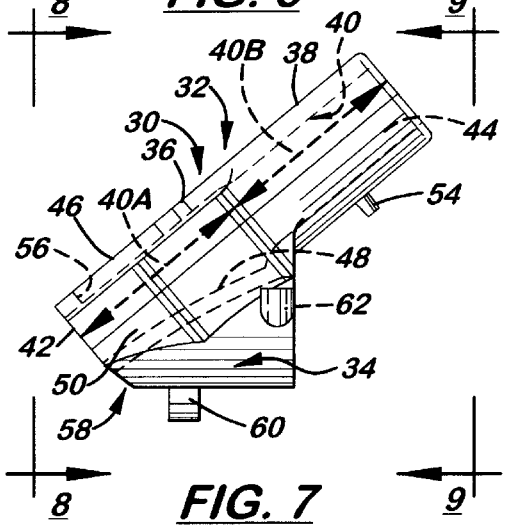
FIG. 7 is a side elevational view of the vacuum attachment as seen along line 7—7 of FIG. 6.
Figure 9:
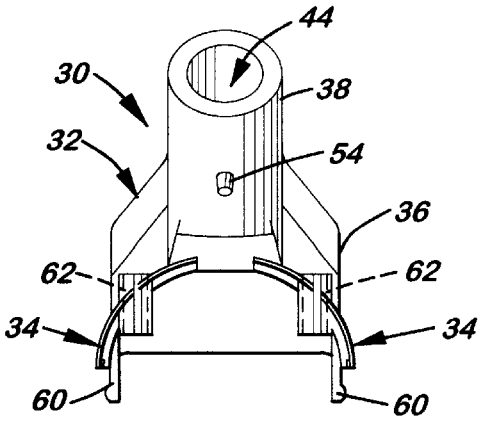
FIG. 9 is a rear elevational view of the vacuum attachment as seen along line 9—9 of FIG. 7.
Figure 10:
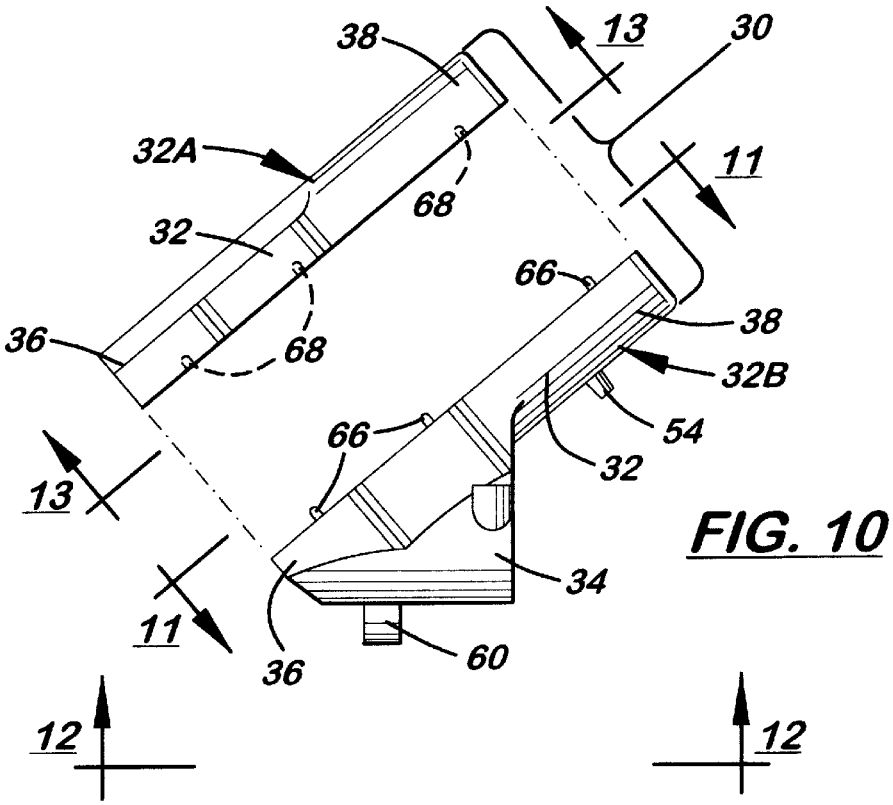
FIG. 10 is a side elevational view of the vacuum attachment showing upper and lower components thereof prior to being assembled and attached together as shown in FIG. 7.
Figure 11:
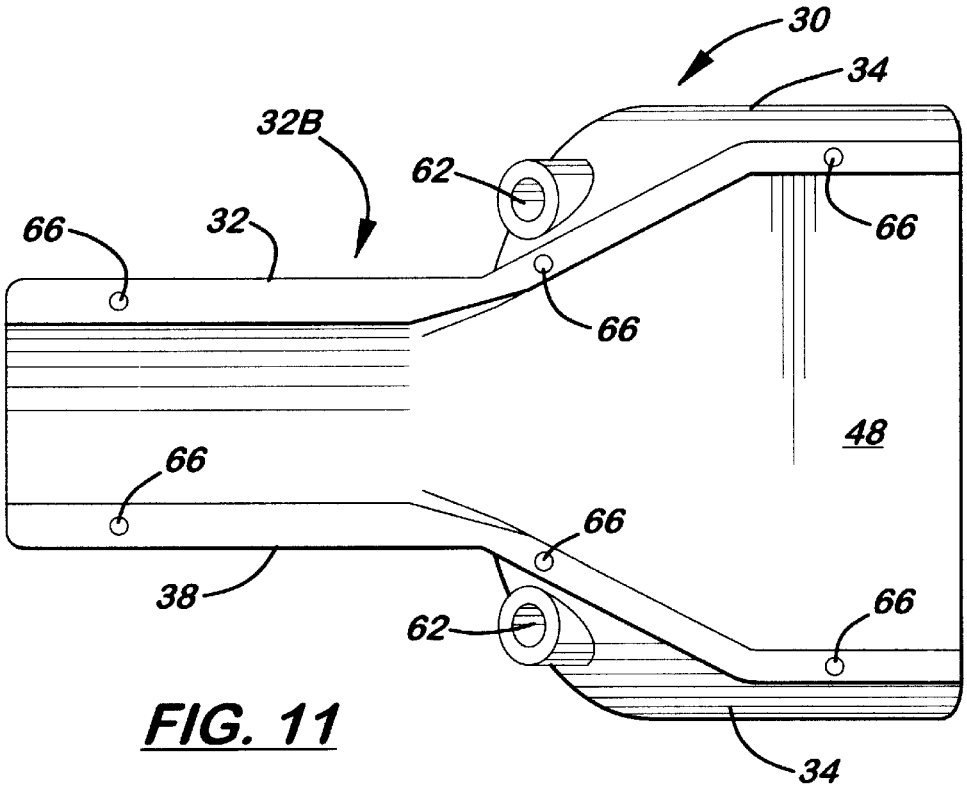
FIG. 11 is an enlarged top plan view of the lower component of the vacuum attachment as seen along line 11—11 of FIG. 10 after being rotated 180°.
Figure 12:
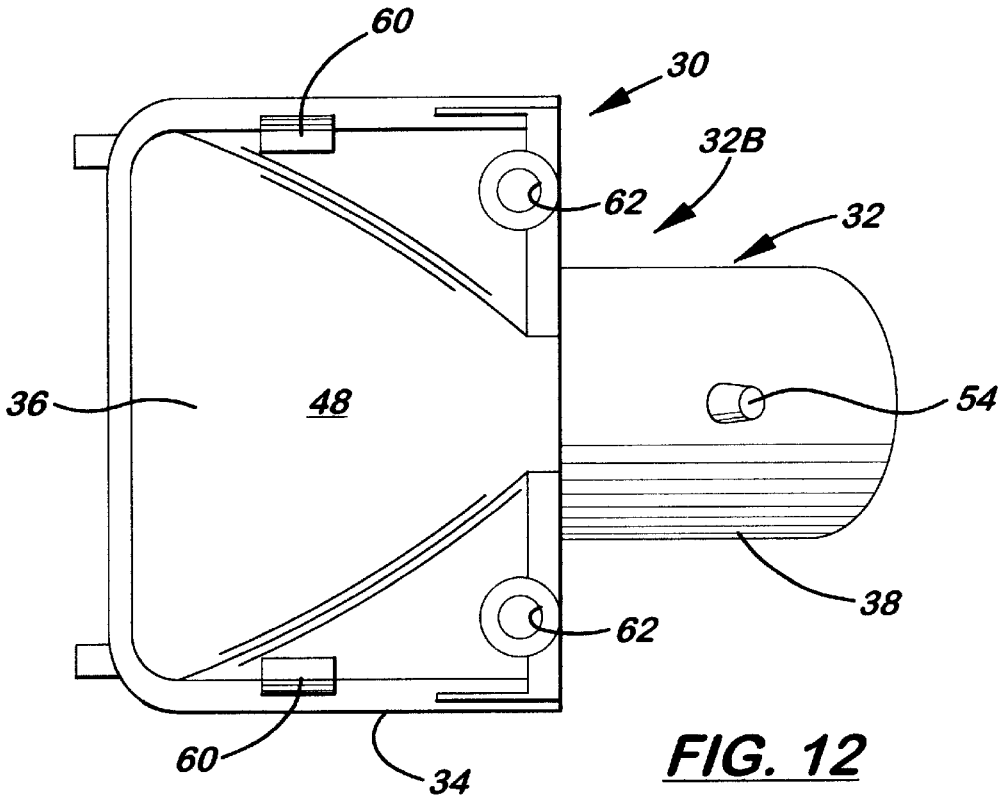
FIG. 12 is an enlarged bottom plan view of the lower component of the vacuum attachment as seen along line 12—12 of FIG. 10.
Figure 13:
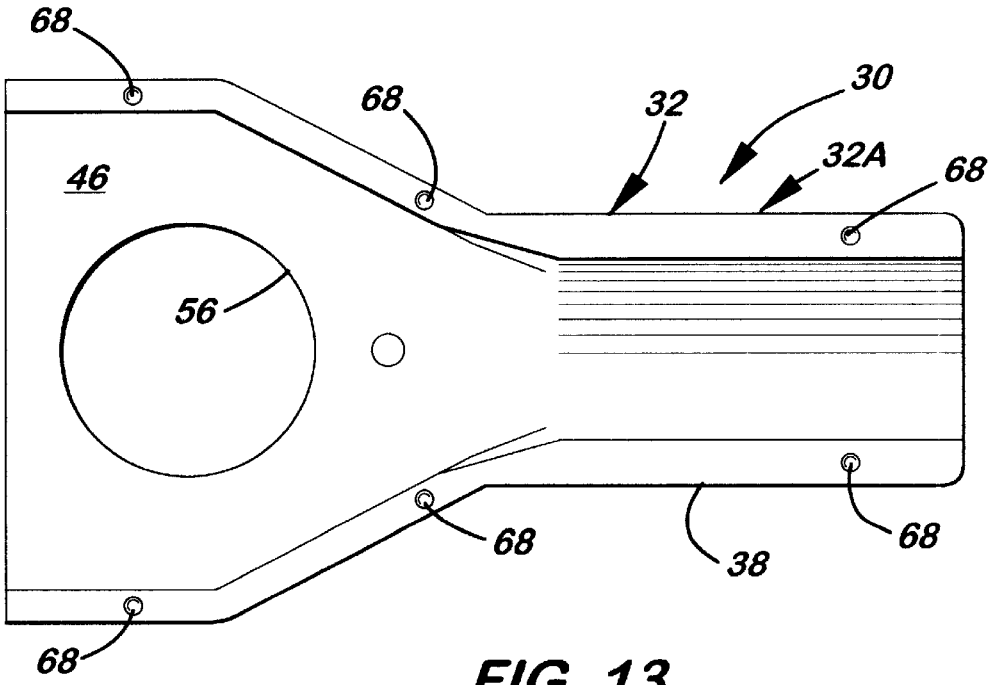
FIG. 13 is an enlarged bottom plan view of the upper component of the vacuum attachment as seen along line 13—13 of FIG. 10.

Referring now to FIGS. 2 and 4, and more particularly to FIGS. 5 to 13, there is illustrated the vacuum attachment of the present invention, being generally designated 30, for use with the hair grooming clipper 10. The vacuum attachment 30 basically includes a conduit body 32 and a pair of mounting wings 34. The conduit body 32 is adapted by the mounting wings 34 for mounting on the forward end 16 of the casing 12 of the clipper 10 adjacent to the front cutting blades 14A of the cutting head mechanism 14 of the clipper 10.

The conduit body 32 has a forward portion 36 and a rearward portion 38 which are integrally connected with one another and together define and enclose an internal air flow passage 40 through the conduit body 32. The conduit body 32 further has an inlet end 42 defined at a front end 36A of the forward portion 36 of the conduit body 32 and an outlet end 44 defined at a rear end 38A of the rearward portion 38 of the conduit body 32. When the conduit body 32 is mounted on the forward end 16 of the casing 12 of the clipper 10, a flow of hair cuttings entrained in air can be drawn from the front cutting blades 14A of the cutting head mechanism 14 of the clipper 10 via the inlet end 42 of the conduit body 32 through the internal air flow passage 40 of the conduit body 32 to an external hose (not shown) coupled to the outlet end 44 of the conduit body 32.

More particularly, the forward portion 36 of the conduit body 32 is formed by an upper wall 46, a lower wall 48 and a pair of side walls 50 extending between and interconnecting the upper and lower walls 46, 48 so as to define a forward section 40A of the passage 40 through the forward portion 36 of the conduit body 32. The forward portion 36 of the conduit body 32 includes a rearwardly tapered segment 52 such that the forward section 40A of the passage 40 of the conduit body 32, which is defined through the forward portion 36 of the conduit body 32, is greater in cross-sectional size than a rearward section 40B of the passage 40 of the conduit body 32, which is defined through the rearward portion 38 of the conduit body 32. The rearward portion 38 of the conduit body 32 is a continuous sidewall of tubular configuration and is integrally connected to and extends rearwardly from the forward portion 36 of the conduit body 32. As in the vacuum attachment disclosed in above-cited U.S. Pat. No. 5,881,462, the rearward portion 38 of the conduit body 32 of the vacuum attachment 10 of the present invention has a nipple 54 formed on and protruding outwardly from the exterior of the rearward portion 38 for securable insertion into a notch (not shown) defined in an external hose (not shown) so as to couple the attachment 10 to the external hose. For performing different lengths and styles of hair cuts on pets, the vacuum attachment 10 of the present invention, like in the case of the vacuum attachment of the above-cited patent, further has a vacuum relief port 56 defined in the upper wall 46 of the forward portion 36 of the conduit body 32. A closure (not shown) in the form of a flexible sealing lid can be mounted to the upper wall 46 so as to overlie the port 56 and is movable in order to vary the amount of area of the vacuum relief port 56 closed by the closure and thereby regulate the degree of relief through the port 56 of the vacuum condition within the passage 40 of the conduit body 32.

The mounting wings 34 have generally triangular configurations and are integrally and externally formed on and extend downwardly from opposite sides of the forward portion 36 of the conduit body 32. The mounting wings 34 and the lower wall 48 of the forward portion 36 of the conduit body 32 that extends between the mounting wings 34 together define a replacement cover 58 that can substitute for and replace the original equipment cover 18 removably provided on the forward end 16 of the casing 12 of the clipper 10 in order to enclose the opening 20 in the casing 12 through which is exposed the cutting head mechanism 14 of the clipper 10.

The vacuum attachment 10 also includes means on the mounting wings 34 for detachably fastening the mounting wings 34 and thereby the conduit body 32 to the forward end 16 of the casing 12 of the clipper 10 so as to overlie and enclose the opening 20 in the forward end 16 of the casing 10. The fastening means includes a pair of tabs 60 each attached on one of the mounting wings 34 for frictionally interfitting with the complementarily shaped elements 24 on the forward end 16 of the casing 12 of the clipper 10. The fastening means also includes a pair of elongated holes 62 each defined in one of the mounting wings 34 and a pair of fasteners, such as replacement screws 64, each insertable through one of the holes 62 and being securable into one of the threaded female sockets 26 formed in the forward end 16 of the casing 12 of the clipper 10. The replacement screws 64 are greater in length than the original screws 28 they replace.

In an exemplary embodiment, the conduit body 32 is manufactured using an suitable conventional technique, such as injection molding, in the form of separate upper and lower components 32A, 32B which are then mated to one another by aligning and interfitting protuberances 66 on the lower component 32B into recesses 68 in the upper component 32A. Then, the interfitted upper and lower components 32A, 32B are permanently attached together, such as by electronic welding, gluing, fusing, etc. The mounting wings 34 are molded with the lower component 32B so as to be integrally attached to the lower component 32B of the conduit body 10.

The present invention also is directed to the method of converting the hair grooming clipper 10 in order to mount the vacuum attachment 10 on the casing 12 of the clipper 10. The converting method comprises the following steps. First, the vacuum attachment 10 is provided having the construction as described above. Second, the original equipment cover 18, provided on the forward end 16 of the casing 12 of the clipper 10 adjacent to the cutting head mechanism 14, is removed to expose the opening 20 in the forward end 16 of the casing 12 overlying the cutting head mechanism 14. Third, the conduit body 32 is installed on the forward end 16 of the casing 12 of the clipper 10 so as to close the opening 20 therein with the replacement cover 58 formed by the mounting wings 34 and the lower wall 48 of the conduit body 32 extending between the mounting wings 34. The integral replacement cover 58 of the conduit body 32 and mounting wings 34 can substitute for and replace the original equipment cover 18 which was removably provided on the forward end 16 of the casing 12 of the clipper 10. The replacement cover 58 of the conduit body 32 thereby encloses the opening 20 in the casing 12 through which is exposed the cutting head mechanism 14 of the clipper 10. Fourth, by screwing replacement screws 64, being of greater length than the original screws 28, into the threaded female sockets 26 in the casing 12, the mounting wings 34 and thus the vacuum attachment 10 are detachably secured to the forward end 16 of the casing 12 of the clipper 10.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A vacuum attachment for use with a hair grooming clipper, comprising:

(a) a conduit body for mounting on a forward end of a casing of a hair grooming clipper adjacent to front cutting blades of a cutting head mechanism of the clipper, said conduit body having a forward portion and a rearward portion which together define and enclose an internal air flow passage through said conduit body, said conduit body also having an inlet end defined at a front end of said forward portion of said conduit body and an outlet end defined at a rear end of said rearward portion of said conduit body such that when said conduit body is mounted on the forward end of the casing of the clipper a flow of hair cuttings entrained in air can be drawn from the front cutting blades of the cutting head mechanism of the clipper via said inlet end of said conduit body through said passage of said conduit body to an external hose coupled to said outlet end of said conduit body;

(b) a pair of mounting wings integrally and externally formed on and extending from opposite sides of said forward portion of said conduit body such that said mounting wings and said forward portion of said conduit body together define a replacement cover that can substitute for and replace an original equipment cover removably provided on the forward end of the casing of the clipper in order to enclose an opening in the casing through which is exposed the cutting head mechanism of the clipper; and (c) means on said mounting wings for detachably fastening said mounting wings and thereby said conduit body to the forward end of the casing of the clipper so as to overlie and enclose the opening in the forward end of the casing.

2. The attachment as recited in claim 1, wherein said conduit body includes upper and lower components mated with and fixedly attached to one another.

3. The attachment as recited in claim 2, wherein said mounting wings are integrally attached to said lower component of said conduit body.

4. The attachment as recited in claim 1, wherein said fastening means includes tabs on said mounting wings for frictionally interfitting with complementarily shaped elements on the forward end of the casing of the clipper.

5. The attachment as recited in claim 1, wherein said fastening means includes a pair of holes each defined in one of said mounting wings and a pair of fasteners each insertable through one of said holes and being securable into one of a pair of threaded sockets formed in the forward end of the casing of the clipper.

6. The attachment as recited in claim 1, wherein said forward portion of said conduit body has an upper wall, a lower wall and a pair of side walls extending between and interconnecting said upper and lower walls so as to define a forward section of said passage through said forward portion of said conduit body.

7. The attachment as recited in claim 6, wherein said forward section of said passage of said conduit body defined through said forward portion of said conduit body is greater in cross-sectional size than a rearward section of said passage of said conduit body defined through said rearward portion of said conduit body.

8. The attachment as recited in claim 1, wherein said forward portion of said conduit body has a rearwardly tapered segment.

9. The attachment as recited in claim 1, wherein said rearward portion of said conduit body is a continuous sidewall of tubular configuration being integrally connected to and extending rearwardly from said forward portion of said conduit body.

10. A vacuum attachment for use with a hair grooming clipper, said attachment comprising:

(a) a conduit body for mounting on a forward end of a casing of a hair grooming clipper adjacent to front cutting blades of a cutting head mechanism of the clipper, said conduit body defining and enclosing an internal air flow passage extending between inlet and outlet ends of said conduit body such that when said conduit body is mounted on the forward end of the casing of the clipper a flow of hair cuttings entrained in air can be drawn from the front cutting blades of the cutting head mechanism of the clipper via said inlet end of said conduit body through said passage thereof to an external hose coupled to said outlet end of said conduit body;

(b) a pair of mounting wings integrally and externally formed on said conduit body and extending from opposite sides of said conduit body such that said mounting wings and a portion of said conduit body extending between said mounting wings define a replacement cover that can substitute for and replace an original equipment cover removably provided on the forward end of the casing of the clipper in order to enclose an opening in the casing through which is exposed the cutting head mechanism of the clipper; and (c) means for detachably fastening said mounting wings to the forward end of the casing of the clipper.

11. The attachment as recited in claim 10, wherein said conduit body includes upper and lower components mated with and fixedly attached to one another.

12. The attachment as recited in claim 11, wherein said mounting wings are integrally attached to said lower component of said conduit body.

13. The attachment as recited in claim 10, wherein said fastening means includes tabs on said mounting wings for frictionally interfitting with complementarily shaped elements on the forward end of the casing of the clipper.

14. The attachment as recited in claim 10, wherein said fastening means includes a pair of holes each defined in one of said mounting wings and a pair of fasteners each insertable through one of said holes and being securable into one of a pair of threaded sockets formed in the forward end of the casing of the clipper.

15. The attachment as recited in claim 10, wherein said conduit body includes a forward portion having an upper wall, a lower wall and a pair of side walls extending between and interconnecting said upper and lower walls so as to define a forward section of said passage through said forward portion of said conduit body.

16. The attachment as recited in claim 15, wherein said conduit body also includes a rearward portion defining a rearward section of said passage.

17. The attachment as recited in claim 16, wherein said forward section of said passage of said conduit body defined through said forward portion of said conduit body is greater in cross-sectional size than said rearward section of said passage of said conduit body defined through said rearward portion of said conduit body.

18. The attachment as recited in claim 15, wherein said forward portion of said conduit body has a rearwardly tapered segment.

19. The attachment as recited in claim 15, wherein said conduit body further includes a rearward portion in the form of a continuous sidewall of tubular configuration being integrally connected to and extending rearwardly from said forward portion.

20. A method of converting a hair grooming clipper to mount a vacuum attachment, comprising the steps of:

(a) providing a vacuum attachment including a conduit body and side mounting wings integrally and externally formed thereon, the conduit body enclosing an internal air flow passage extending between inlet and outlet ends of the conduit body such that when the vacuum attachment is mounted on a forward end of a casing of a hair grooming clipper a flow of hair cuttings entrained in air can be drawn from front cutting blades of a cutting head mechanism of the clipper via the inlet end of the conduit body through the passage thereof to an external hose coupled to the outlet end of the conduit body;

(b) removing from the forward end of the casing of the clipper an original equipment cover removably provided thereon adjacent to the cutting head mechanism to expose an opening in the forward end of the casing overlying the cutting head mechanism;

(c) installing the conduit body on the forward end of the casing of the clipper so as to close the opening therein with a replacement cover, formed by the side mounting wings and a portion of the conduit body extending between the side mounting wings, that can substitute for and replace the original equipment cover removed from the forward end of the casing of the clipper in order to enclose the opening in the forward end of the casing of the clipper; and (d) detachably fastening the side mounting wings to the forward end of the casing of the clipper.

* * * * *